US012799848B2

(12) United States Patent
Fan et al.

(10) Patent No.: US 12,799,848 B2
(45) Date of Patent: Nov. 17, 2026

(54) FULL-BORE CEMENTING AND FRACTURING SLIDING SLEEVE SYSTEM

(71) Applicant: Sichuan Pangolin Petroleum Technology Co., Ltd., Chengdu (CN)

(72) Inventors: Xiuping Fan, Chengdu (CN); Yuqi Fan, Chengdu (CN)

(73) Assignee: Sichuan Pangolin Petroleum Technology Co., Ltd., Chengdu (CN)

( * ) Notice: Subject to any disclaimer, the term of this patent is extended or adjusted under 35 U.S.C. 154(b) by 20 days.

(21) Appl. No.: 19/215,922

(22) Filed: May 22, 2025

(65) Prior Publication Data

US 2026/0160150 A1 Jun. 11, 2026

(30) Foreign Application Priority Data

Dec. 9, 2024 (CN) ..... 202411796721.8

(51) Int. Cl.

| | |
|---|---|
| ***E21B 34/14*** | (2006.01) |
| ***E21B 17/10*** | (2006.01) |
| ***E21B 23/04*** | (2006.01) |
| ***E21B 33/128*** | (2006.01) |
| ***E21B 33/129*** | (2006.01) |
| ***E21B 33/134*** | (2006.01) |
| ***E21B 34/06*** | (2006.01) |

(52) U.S. Cl.

CPC ..... *E21B 34/142* (2020.05); *E21B 17/1078* (2013.01); *E21B 23/0413* (2020.05); *E21B 33/128* (2013.01); *E21B 33/129* (2013.01); *E21B 33/1293* (2013.01); *E21B 33/134* (2013.01); *E21B 34/063* (2013.01)

(58) Field of Classification Search

CPC ..... E21B 34/142; E21B 23/0413; E21B 17/1078; E21B 33/128; E21B 33/129; E21B 33/1293; E21B 33/134; E21B 34/063

See application file for complete search history.

(56) References Cited

U.S. PATENT DOCUMENTS

| | | | | |
|---|---|---|---|---|
| 11,828,149 | B1 * | 11/2023 | Tian | E21B 43/26 |
| 2007/0221384 | A1 * | 9/2007 | Murray | E21B 34/063 166/185 |
| 2013/0161017 | A1 * | 6/2013 | King | E21B 34/142 166/318 |
| 2014/0034310 | A1 * | 2/2014 | Andersen | E21B 23/08 166/281 |
| 2014/0246209 | A1 * | 9/2014 | Themig | E21B 34/142 166/194 |

(Continued)

*Primary Examiner* — Neel Girish Patel
(74) *Attorney, Agent, or Firm* — Birchwood IP

(57) ABSTRACT

Disclosed is a full-bore cementing and fracturing sliding sleeve system. An inner wall of a ball seat is provided with a step for clamping a soluble ball, an outer wall of a bottom end of the ball seat is in threaded connection with a body tube, a pressure ring assembly, a rubber cylinder, a pressure ring assembly, a wedge-shaped body, a slip and an elastic tube are sequentially sleeved outside a body tube, the wedge-shaped body is fixed on the body tube by a plurality of first shearing pins in a circumferential array, an outer wall of the wedge-shaped body adapts to an inner wall of the slip by an inclined plane, the elastic tube is fixed on the body tube by a plurality of second shearing pins in a circumferential array. The sealing performance and pressure-bearing capacity are improved.

10 Claims, 16 Drawing Sheets

(56) References Cited

U.S. PATENT DOCUMENTS

| | | | | |
|---|---|---|---|---|
| 2015/0184489 | A1* | 7/2015 | Resweber | E21B 34/14 166/183 |
| 2016/0040492 | A1* | 2/2016 | Vinson | E21B 23/08 166/386 |
| 2016/0084040 | A1* | 3/2016 | Brasseaux | E21B 34/10 166/194 |
| 2016/0251923 | A1* | 9/2016 | Keerthivasan | E21B 23/08 166/383 |
| 2021/0156211 | A1* | 5/2021 | Arabskyy | E21B 23/0413 |
| 2021/0293112 | A1* | 9/2021 | Smith | E21B 34/142 |
| 2021/0404285 | A1* | 12/2021 | Reyes Villegas | E21B 33/1292 |
| 2022/0056773 | A1* | 2/2022 | Jacob | E21B 33/128 |

* cited by examiner

FULL-BORE CEMENTING AND FRACTURING SLIDING SLEEVE SYSTEM

CROSS-REFERENCE TO RELATED APPLICATIONS

This application claims priority to Chinese Patent Application No. 202411796721.8, filed on Dec. 9, 2024, which is hereby incorporated by reference in its entirety.

TECHNICAL FIELD

The present invention relates to the technical field of oil and gas well fracturing, and in particular, to a full-bore cementing and fracturing sliding sleeve system.

BACKGROUND

In the fracturing operation of oil and gas wells, multi-stage segmented fracturing is a commonly used technology aimed at improving the recovery rate of oil and gas. The principle of multi-stage segmented fracturing is as follows: a soluble plunger is placed into a wellbore and clamped in a corresponding sliding sleeve to form a sealed area to isolate different fracturing sections, so that fracturing operations may be performed in this area; after fracturing is completed, the soluble plunger dissolves under specific conditions (such as temperature, pressure or chemical reaction).

Sealing and pressure-bearing capacity are two keys to successful fracturing. In a case that the structural design, material selection or installation of the sliding sleeve and the soluble plunger are improper, the seal between the sliding sleeve and the soluble plunger is not tight enough, which affects the fracturing effect. In addition, the soluble plunger is clamped in the sliding sleeve and mainly bears pressure by a clamped point position of the soluble plunger, and in a case that the structural design between the sliding sleeve and the soluble plunger is improper, the soluble plunger cannot bear the stress under high-pressure environment, which causes the soluble plunger to rupture or fail.

To effectively perform fracturing construction, improve the flexibility and accuracy of fracturing operations, and reduce operating costs and complexity, the present invention redesigns the structure of the sliding sleeve and the soluble plunger to enhance the sealing performance and pressure-bearing capacity.

SUMMARY

To solve the defects in the prior art, the present invention provides a full-bore cementing and fracturing sliding sleeve system to improve the sealing performance and pressure-bearing capacity.

To achieve the objective of the present invention, the following solution is adopted.

A full-bore cementing and fracturing sliding sleeve system includes a plurality of soluble plungers and a plurality of sliding sleeves;

The soluble plunger includes a soluble ball, a rubber cylinder, two pressure ring assemblies, a wedge-shaped body, a slip, a ball seat, a body tube, an elastic tube and a front seat; an opening is arranged at a top of the ball seat, an inner wall of the ball seat is provided with a step for clamping the soluble ball, an outer wall of a bottom end of the ball seat is in threaded connection with the body tube, starting from the ball seat, the pressure ring assembly, the rubber cylinder, the pressure ring assembly, the wedge-shaped body, the slip and the elastic tube are sequentially sleeved outside the body tube, the wedge-shaped body is fixed on the body tube by a plurality of first shearing pins in a circumferential array, an outer wall of the wedge-shaped body adapts to an inner wall of the slip by an inclined plane, the elastic tube is fixed on the body tube by a plurality of second shearing pins in a circumferential array, the front seat is in threaded connection with a bottom of the elastic tube, a plurality of elastic sheets are arranged on an outer wall of the elastic tube in a circumferential array, a bottom end of the elastic sheet is in an acute angle structure, a top end of the elastic sheet is in an obtuse angle structure, and a strip-shaped groove penetrating through the elastic tube is arranged on each of two sides of the elastic sheet;

A clamping groove is arranged on an inner wall of the sliding sleeve, and a bottom end of the clamping groove is in an acute angle structure; and the plurality of sliding sleeves are assembled together in the order of gradually increasing lengths of the clamping grooves from top to bottom, and the clamping groove is used to clamp the elastic sheet corresponding to the soluble plunger.

The beneficial effects of the present invention are as follows.

1. The rubber cylinder is squeezed, causing the rubber of the rubber cylinder to expand and fit tightly against the inner wall of the sliding sleeve to achieve effective sealing.

2. The pressure-bearing level of the soluble plunger is 70 MPa, which is achieved by the following two aspects: firstly, the soluble plunger bears pressure by the elastic sheets, and the bottom end of the elastic sheet may be downwards inserted into the clamping groove, so that the pressure-bearing capacity is improved; and secondly, the slips are opened and tightly clamp the inner wall of the sliding sleeve, so that the pressure-bearing effect may be achieved.

3. The lengths of the clamping grooves of the sliding sleeves are different. The sliding sleeves are assembled in a specific order and placed into a wellbore in the order of increasing lengths of the sliding grooves from top to bottom. Then the corresponding soluble plungers are placed into the wellbore in turn to ensure that the soluble plungers are clamped in the sliding sleeves at specific positions to improve accuracy.

4. After fracturing is completed, the sliding sleeve still maintains a full-bore passage, facilitating subsequent well repair operations.

5. The continuous fracturing operation without perforation and additional packers for layer isolation not only ensures the continuity of the fracturing process but also reduces the operation time and saves costs.

6. The sliding sleeve may effectively avoid casing deformation caused by weakening of the casing due to perforation.

7. The sliding sleeve is opened and closed by a soluble plunger. When the sliding sleeve is opened and fracturing is performed, only the soluble plunger remains in the wellbore, which can effectively reduce construction accidents.

8. The problem of water production from oil layers after conventional casing perforation is avoided. A closing tool may be lowered into the coiled tubing to close the sliding sleeve at a water production position, which is simple and convenient to operate.

9. The use of the sliding sleeve greatly increases the integrity of the casing. The characteristic of the sliding sleeve that may be opened and closed multiple times can effectively avoid the conventional one-time exploitation method and reserve operation space for later production layer processing.

10. The elastic sheet of the soluble plunger is easy to operate and has high reliability.

11. Even if the casing is slightly deformed, the permeability of the soluble plunger and the subsequent fracturing construction are not affected.

12. The soluble plunger may be directly placed without the assistance of other equipment, which greatly saves costs.

13. This system is a purely mechanical structure without any electronic components.

DESCRIPTION OF EMBODIMENTS

Figure 1:
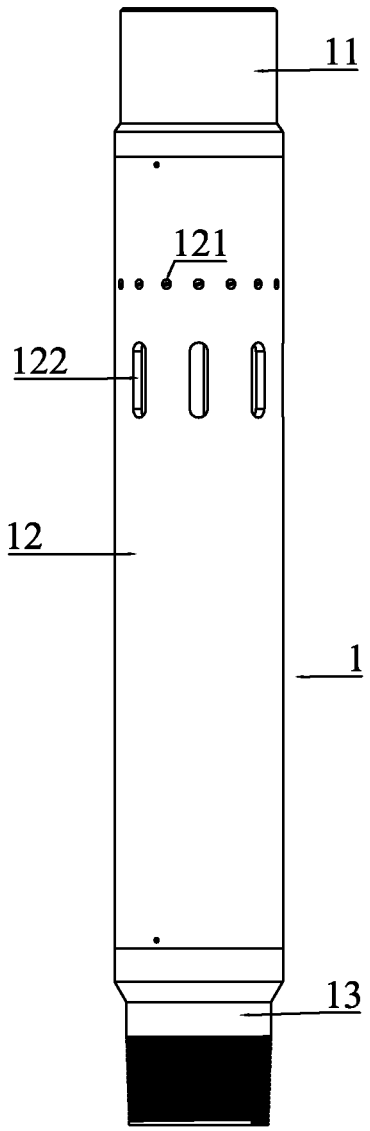
FIG. 1 is a diagram of an external structure of a sliding sleeve.
Figure 10:
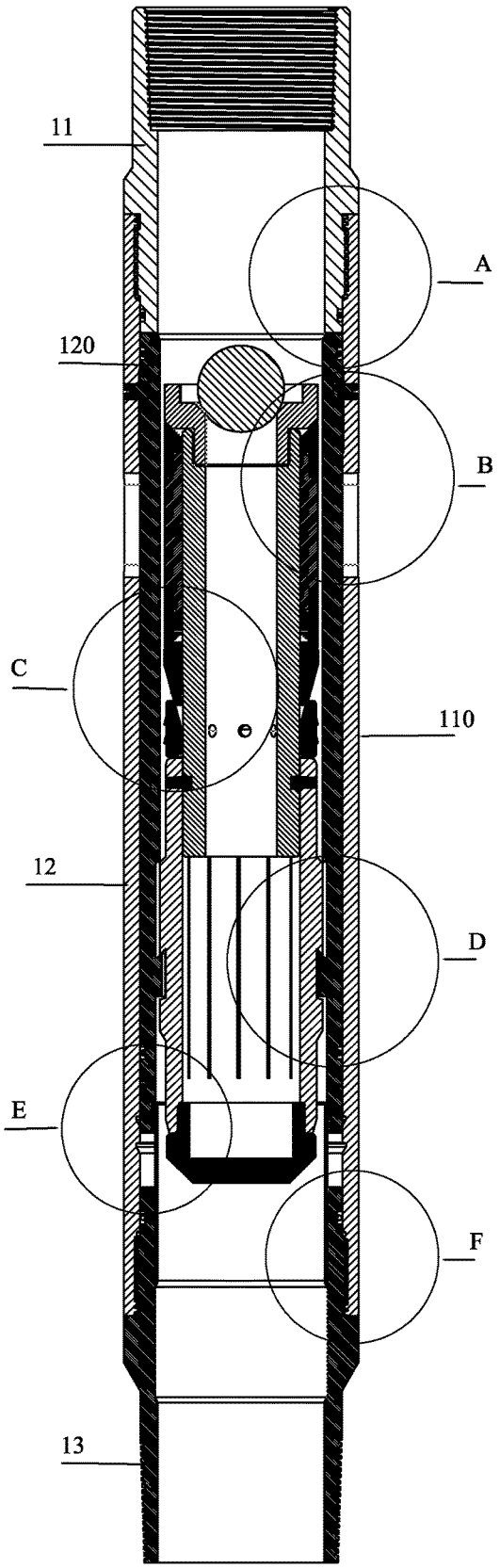
FIG. 10 is a cross-sectional view of a soluble plunger clamped in a sliding sleeve.
Figure 14:
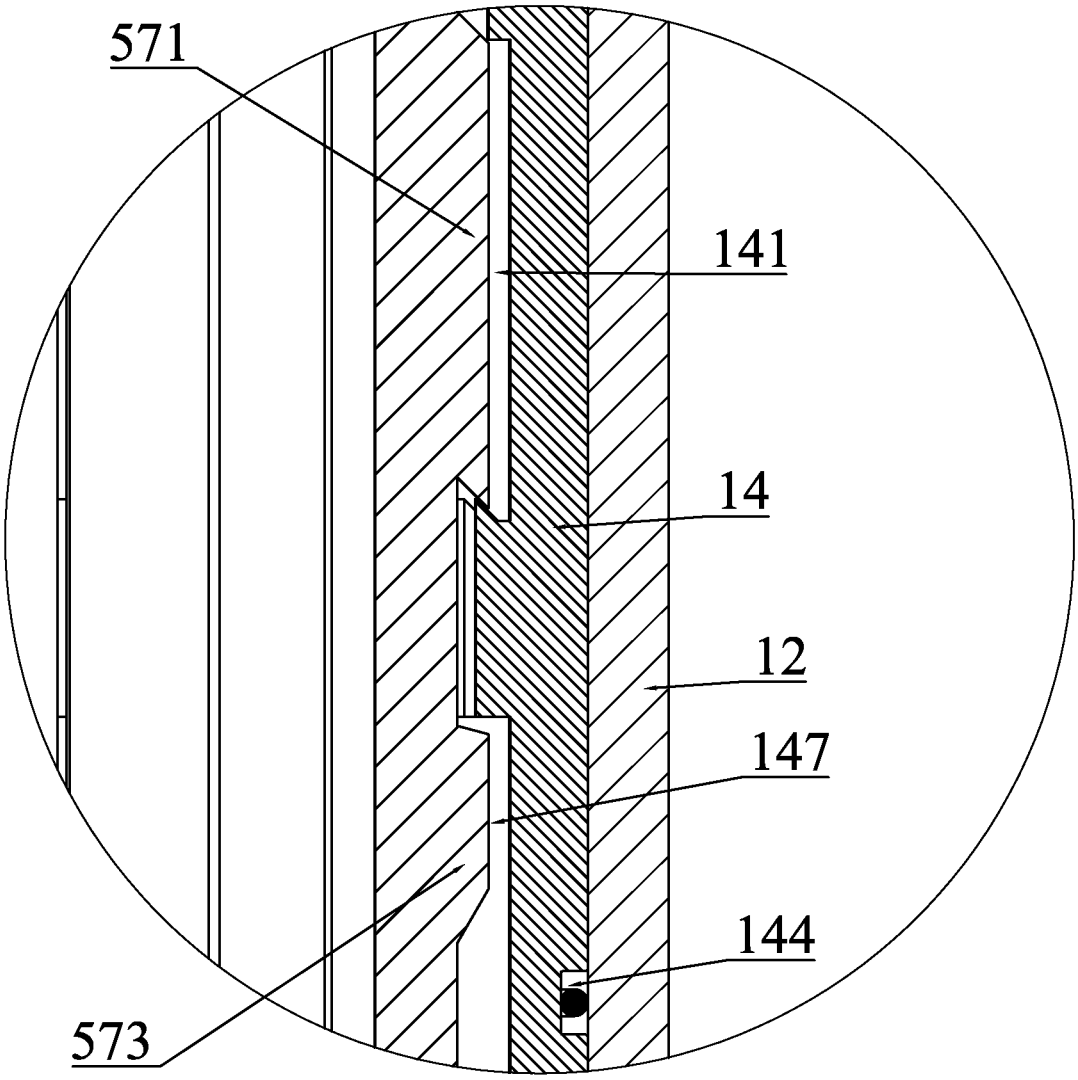
FIG. 14 is a partial enlarged view of D in FIG. 10.

As shown in FIGS. 1, 10, and 14, this embodiment provides a full-bore cementing and fracturing sliding sleeve system, which includes a plurality of soluble plungers 5 and a plurality of sliding sleeves 1, wherein a clamping groove 141 is arranged on an inner wall of each of the sliding sleeves, a bottom end of the clamping groove 141 is in an acute angle structure, the plurality of sliding sleeves 1 are assembled together in the order of gradually increasing lengths of the clamping grooves 141 from top to bottom, and the soluble plungers 5 are clamped in corresponding sliding sleeves.

Specifically, as shown in FIGS. 2, 3, and 10-14, the soluble plunger 5 includes a soluble ball 51, a rubber cylinder 52, two pressure ring assemblies 3, a wedge-shaped body 53, a slip 54, a ball seat 55, a body tube 56, an elastic tube 57 and a front seat 58; an opening is arranged at a top of the ball seat 55, an inner wall of the ball seat 55 is provided with a step for clamping the soluble ball 51, an outer wall of a bottom end of the ball seat 55 is in threaded connection with the body tube 56, starting from the ball seat 55, the pressure ring assembly 3, the rubber cylinder 52, the pressure ring assembly 3, the wedge-shaped body 53, the slip 54 and the elastic tube 57 are sequentially sleeved outside the body tube 56, the wedge-shaped body 53 is fixed on the body tube 56 by a plurality of first shearing pins 21 in a circumferential array, an outer wall of the wedge-shaped body 53 adapts to an inner wall of the slip 54 by an inclined plane, an outer wall of a top end of the elastic tube 57 is fixed on the body tube 56 by a plurality of second shearing pins 22 in a circumferential array, an outer wall of a top end of the front seat 58 is in threaded connection with a bottom of the elastic tube 57, a plurality of elastic sheets 571 are arranged on an outer wall of the elastic tube 57 in a circumferential array, an outer wall of the elastic sheet 571 is arc-shaped, and a center of the arc is positioned on a central axis of the elastic tube 57; a bottom end of the elastic sheet 571 is in an acute angle structure, a top end of the elastic sheet is in an obtuse angle structure, a strip-shaped groove 572 penetrating through the elastic tube 57 is arranged on each of two sides of the elastic sheet 571; the function of the strip-shaped groove 572 is to enable the elastic tube 57 to deform elastically, and the soluble plunger 5 is clamped in the clamping groove 141 of the corresponding sliding sleeve by the elastic sheet 571.

From a wellhead to a bottomhole, the length of the clamping groove 141 of the sliding sleeve gradually increases, so that a soluble plunger 5 with a longest elastic sheet 571 is placed when the soluble plungers 5 are place into the wellbore, and then the soluble plungers 5 with the elastic sheets 571 with gradually decreasing lengths are placed successively.

The sealing principle is as follows:

After the soluble plunger 5 is clamped in the corresponding sliding sleeve, pressure is applied to the soluble plunger 5, the elastic sheet 571 is tightly clamped in the clamping groove 141, the soluble ball 51, the ball seat 55, the body tube 56, the rubber cylinder 52, the two pressing ring assemblies 3 and the wedge-shaped body 53 integrally move downwards, the second shearing pin 22 of the elastic tube 57 is sheared off by force, and the first shearing pin 21 of the wedge-shaped body 53 is sheared off by force. In this process, a tip at a bottom of the wedge-shaped body 53 squeezes the slip 54 to enable the slip 54 to open and clamp the inner wall of the sliding sleeve, and the two pressing ring assemblies 3 squeeze the rubber cylinder 52 to enable the rubber of the rubber cylinder 52 to expand and fit tightly against the inner wall of the sliding sleeve to achieve sealing.

The pressure-bearing condition is as follows:

Firstly, the elastic sheet 571 is used to bear pressure, and the bottom end of the elastic sheet 571 may downwards inserted into the clamping groove 141, so that the pressure-bearing capacity is improved; and secondly, the slip 54 is opened and tightly clamps the inner wall of the sliding sleeve, so that the pressure-bearing effect may be achieved.

When the soluble plunger 5 is placed into the wellbore, the elastic sheet 571 is in a compressed state when entering the well. To ensure that the soluble plunger 5 smoothly enters the well and reaches the sliding sleeve at a specific position, the following solutions are adopted in this embodiment. As shown in FIGS. 2, 3, 10, and 14, a plurality of centralizing fins 573 are further arrayed on an outer wall of the elastic tube 57 along a circumferential direction, the number and positions of the centralizing fins 573 correspond to those of the elastic sheets 571 one by one, an outer diameter of the centralizing fin 573 is greater than that of the elastic sheet 571, the centralizing fin 573 is positioned between the elastic sheet 571 and the front seat 58, a bottom end and a top end of the centralizing fin 573 are in an obtuse angle structure, a bottom end of the strip-shaped groove 572 is positioned between the centralizing fin 573 and the front seat 58, a circle of avoiding grooves 147 are arranged on an inner wall of the sliding sleeve, and when the soluble plunger 5 is clamped in a corresponding clamping groove 141, the centralizing fin 573 is positioned in the avoiding groove 147.

Since the outer diameter of the centralizing fin 573 is slightly greater than that of the elastic sheet 571, when the soluble plunger 5 enters a space with a small inner diameter from a large inner diameter of the sliding sleeve, the centralizing fin 573 is compressed, and then the centralizing fin 573 drives the elastic sheet 571 to be compressed as a whole, which ensures that the entire soluble plunger 5 is not clamped when entering a space with a small inner diameter, and further ensures that the soluble plunger 5 is clamped in a clamping groove 141 with a specific length.

The specific structure of the pressure ring assembly 3 is as follows: as shown in FIGS. 2, 3, 12, and 13, a groove 301 is formed in an area among the ball seat 55, the wedge-shaped body 53 and the outer wall of the body tube 56, two pressure ring assemblies 3 are symmetrically arranged in the groove 301 up and down, and each of the pressure ring assemblies 3 sequentially includes a first ring 31, a second ring 32, a third ring 33 and a fourth ring 34. For an upper pressure ring assembly 3, the first ring 31 adapts to the ball seat 55 by an inclined plane, the first ring 31 adapts to the second ring 32 by a step, the second ring 32 adapts to the third ring 33 by an inclined plane, the fourth ring 34 adapts to the rubber cylinder 52 by a step. For a lower pressure ring assembly 3, the first ring 31 adapts to the wedge-shaped body 53 by an inclined plane, and a cross-sectional shape of the fourth ring 34 may be rectangular or L-shaped.

Figure 12:
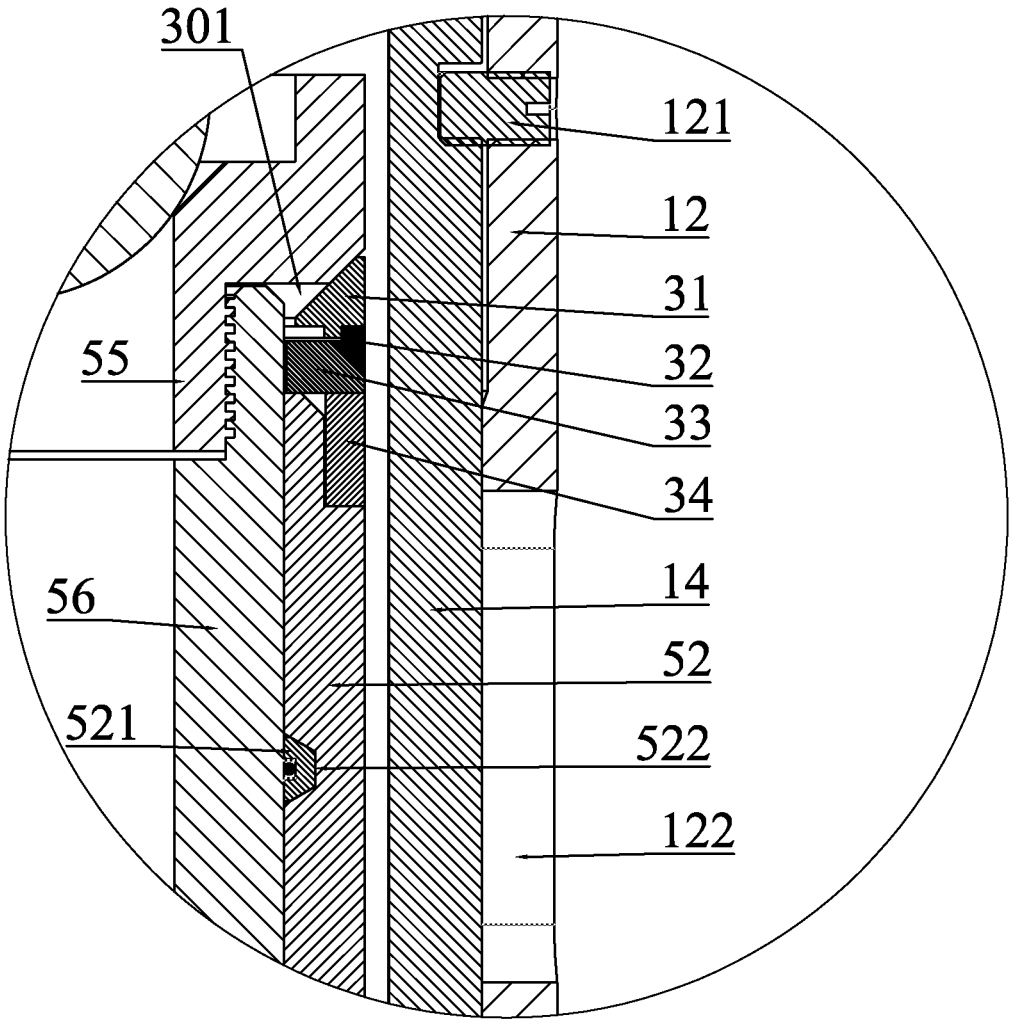
FIG. 12 is a partial enlarged view of B in FIG. 10.
Figure 13:
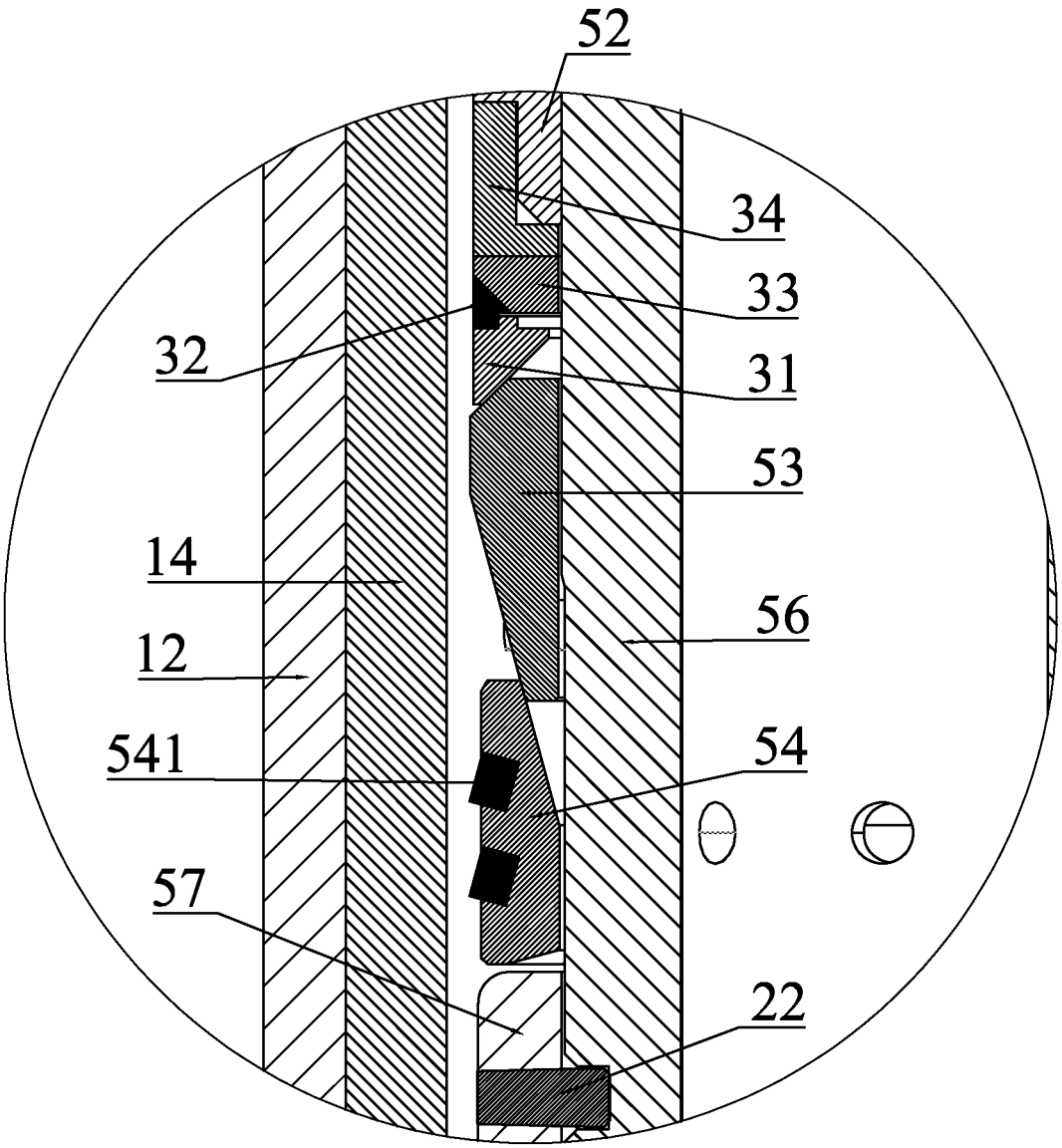
FIG. 13 is a partial enlarged view of C in FIG. 10.

As shown in FIG. 12, a circle of trapezoidal grooves 522 are provided on an inner wall of the rubber cylinder 52, a sealing sleeve 521 and a sealing ring are arranged in the trapezoidal groove 522, and the sealing ring is positioned inside the sealing sleeve 521.

Figure 2:
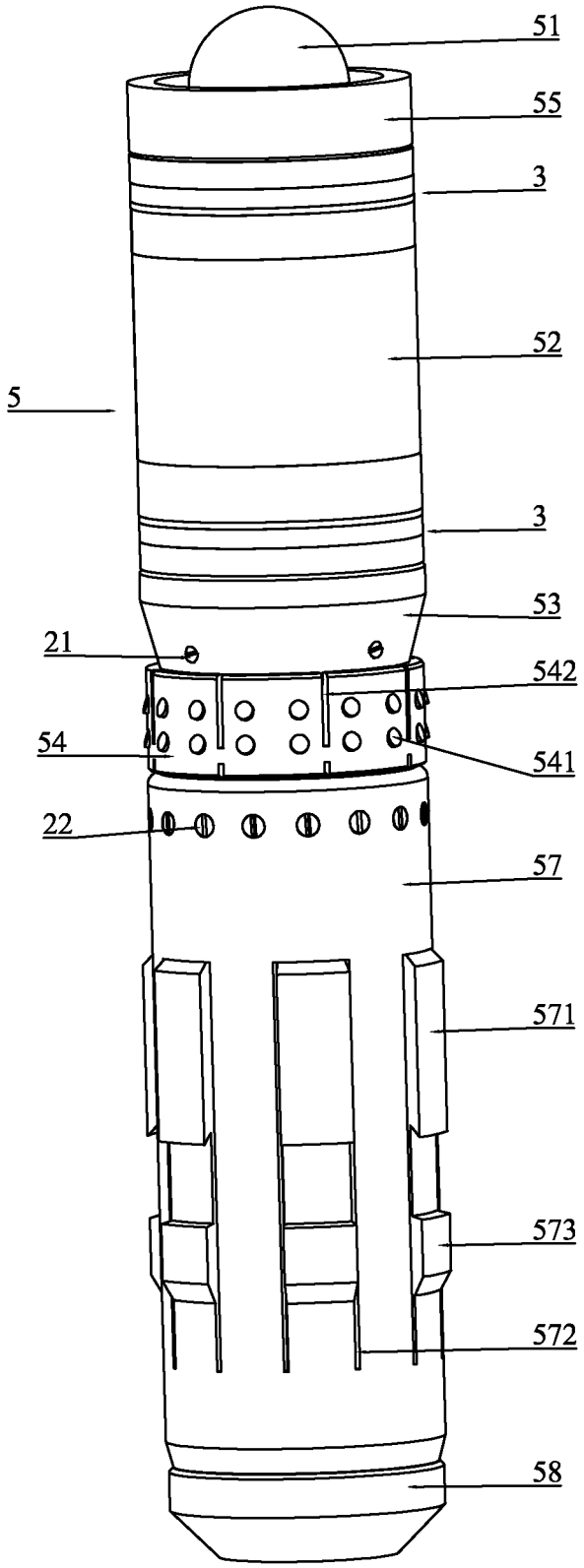
FIG. 2 is a diagram of an external structure of a soluble plunger.
Figure 3:
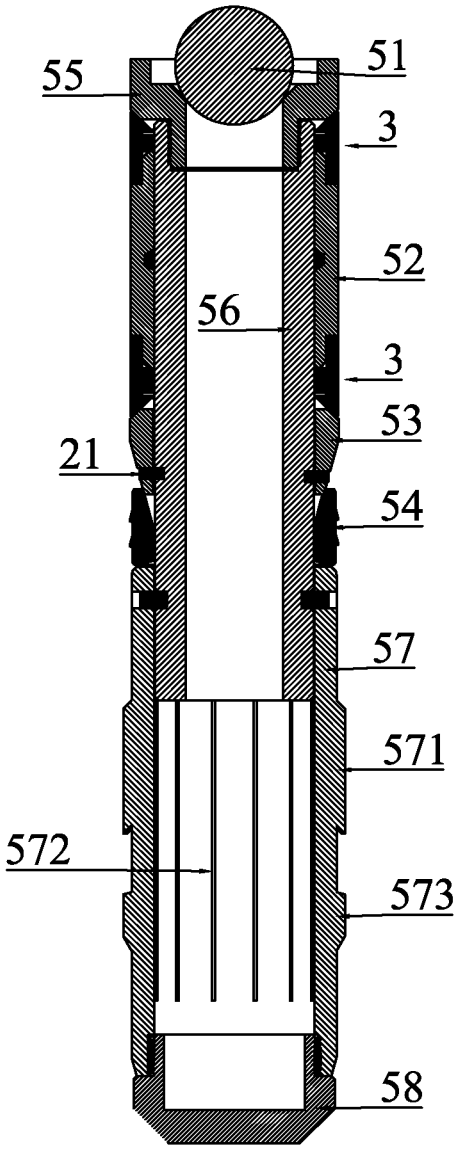
FIG. 3 is a cross-sectional view of a soluble plunger.

The specific structure of the slip 54 is as follows: as shown in FIG. 2, two circles of inserted pins 541 are arranged on an outer wall of the slip 54, and notches 542 are arranged at corresponding positions at upper and lower ends of the slip 54. The function of the notch 542 is to ensure that when the tip at the bottom of the wedge-shaped body 53 squeezes the slip 54, the slip 54 may be smoothly opened and clamped to an inner wall of the sliding sleeve.

The soluble plunger 5 provided by this embodiment has the following performance advantages:

(1) Adapting to different temperature ranges of 38° C. to 178° C. (100 F to 350 F);
(2) Providing various material combination designs to meet the requirements of different blocks;
(3) Having a pressure-bearing level of 70 MPa (10000 PSI) and being designed with an integrated anti-premature setting feature, enabling to set within a specific position of the sliding sleeve;
(4) Being made of 100% metal soluble material, which is completely dissolved within 5 days (the dissolution time may be adjusted according to the site requirements);
(5) Having a metal surface refined and coated, and sprayed with acid-resistant, water-soluble, and anti-corrosion surface to adapt to the construction wells immersed in acid injection;
(6) Being suitable for all current casing steel grades (P110/125/140, and the like); and
(7) Having a maximized inner diameter design, which is conducive to flowback after fracturing without affecting production.

The specific structure of the sliding sleeve is as follows: as shown in FIGS. 1 and 14-16, the sliding sleeve includes an outer tube 110 and an inner tube 120 arranged therein, the outer tube 110 includes a first casing 11, a second casing 12 and a third casing 13 which are threadedly connected in sequence, the inner tube 120 includes a fourth casing 14 and a fifth casing 15 which are threadedly connected in sequence, an outer wall of the fourth casing 14 tightly fits against an inner wall of the second casing 12, a gap 16 is provided between an outer wall of the fifth casing 15 and an inner wall of the second casing 12, an outer wall of the fifth casing 15 tightly fits against an inner wall of the third casing 13, the second casing 12 is fixedly connected to the fourth casing 14 by a plurality of third shearing pins 121 in a circumferential array, the second casing 12 is further circumferentially arrayed with a plurality of fracturing holes 122, the third shearing pins 121 are positioned between the first casing 11 and the fracturing holes 122, and the clamping groove 141 and the avoiding groove 147 are arranged on an inner wall of the fourth casing 14.

Figure 4:
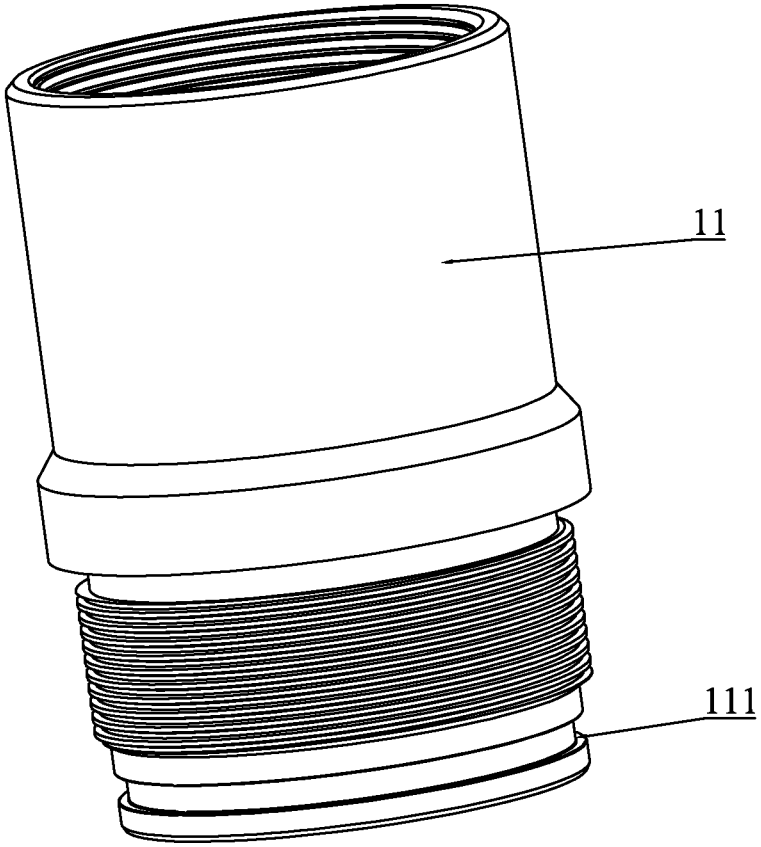
FIG. 4 is a diagram of an external structure of a first casing.
Figure 5:
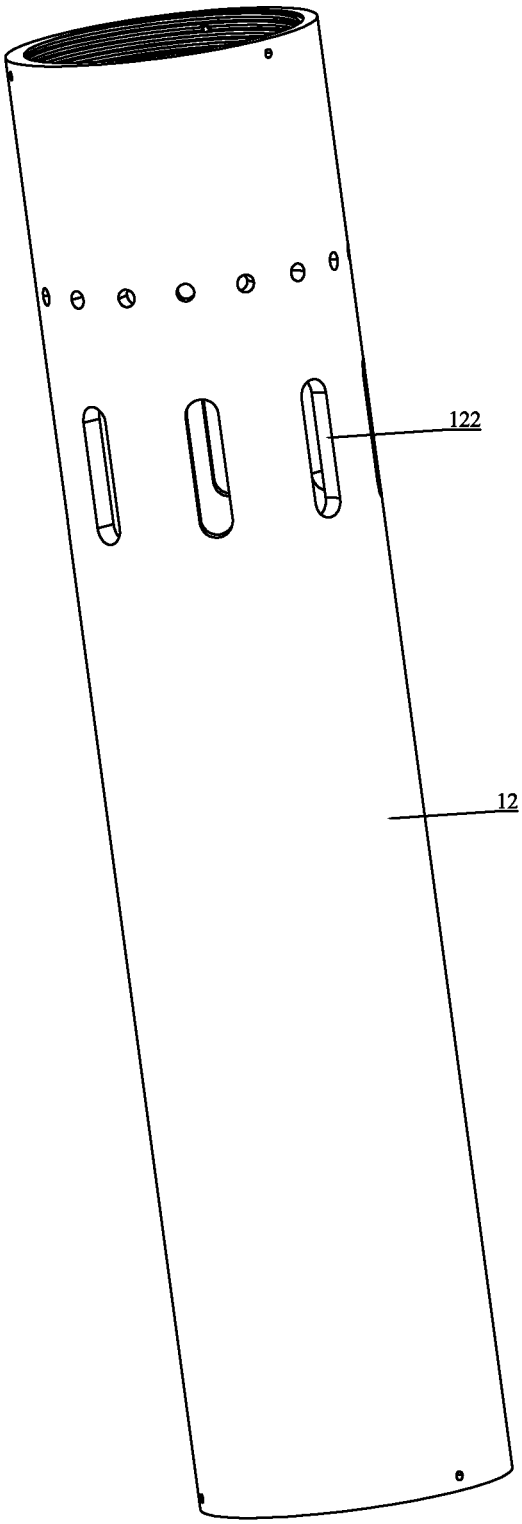
FIG. 5 is a diagram of an external structure of a second casing.
Figure 6:
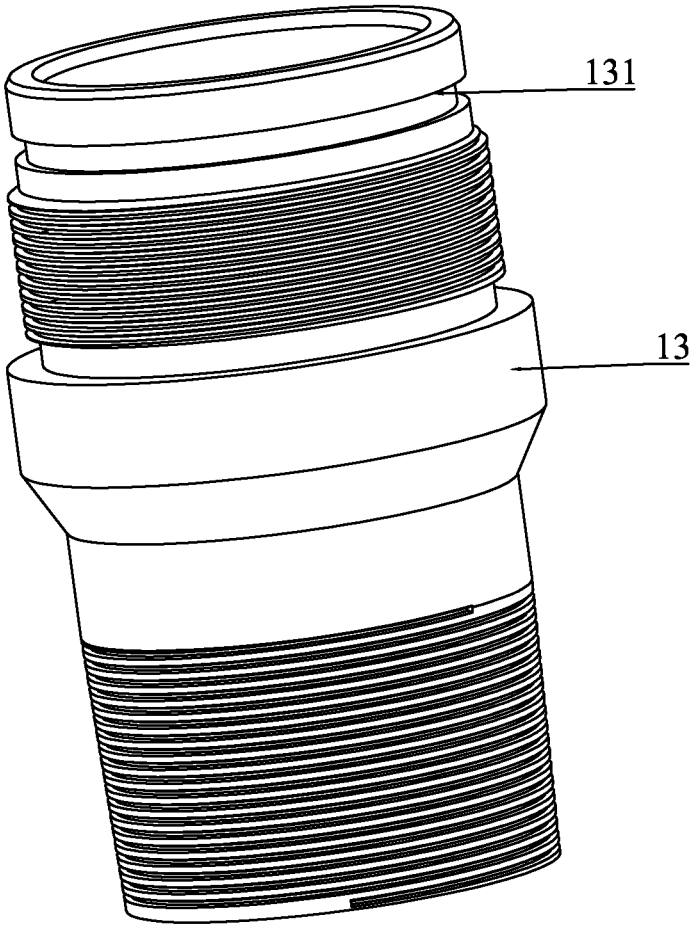
FIG. 6 is a diagram of an external structure of a third casing.
Figure 7:
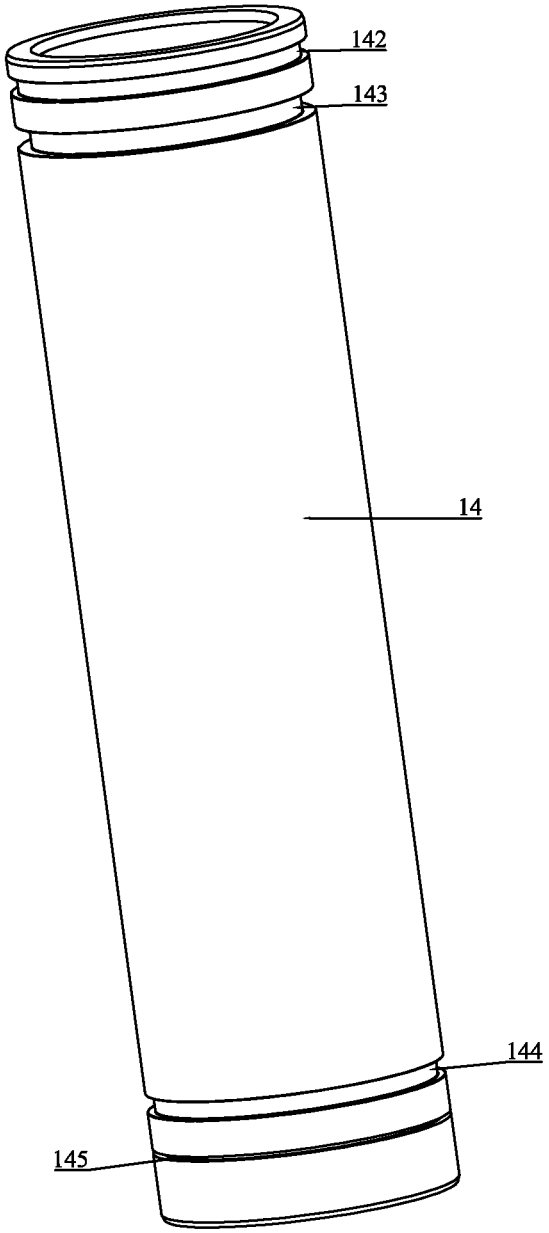
FIG. 7 is a diagram of an external structure of a fourth casing.
Figure 9:
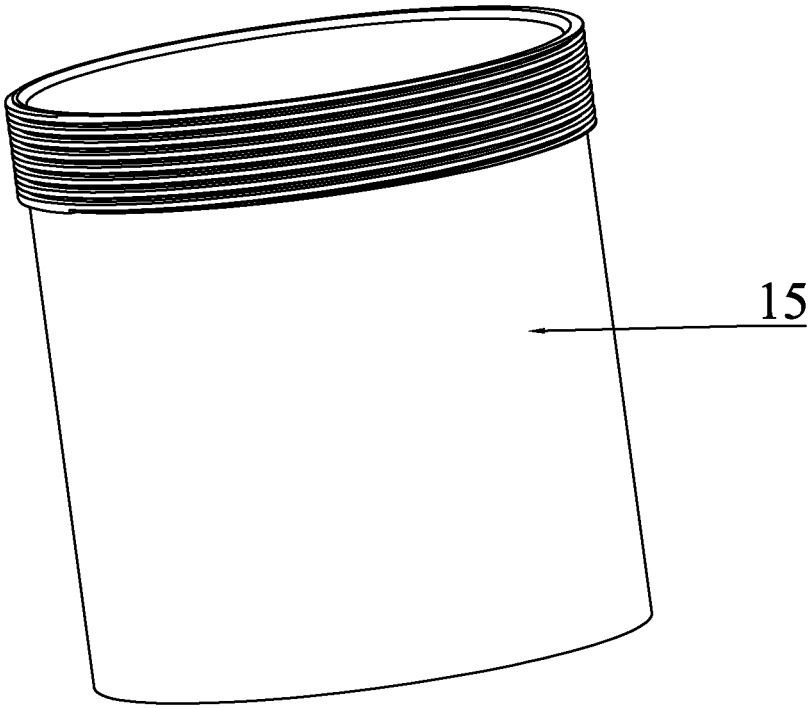
FIG. 9 is a diagram of an external structure of a fifth casing.
Figure 11:
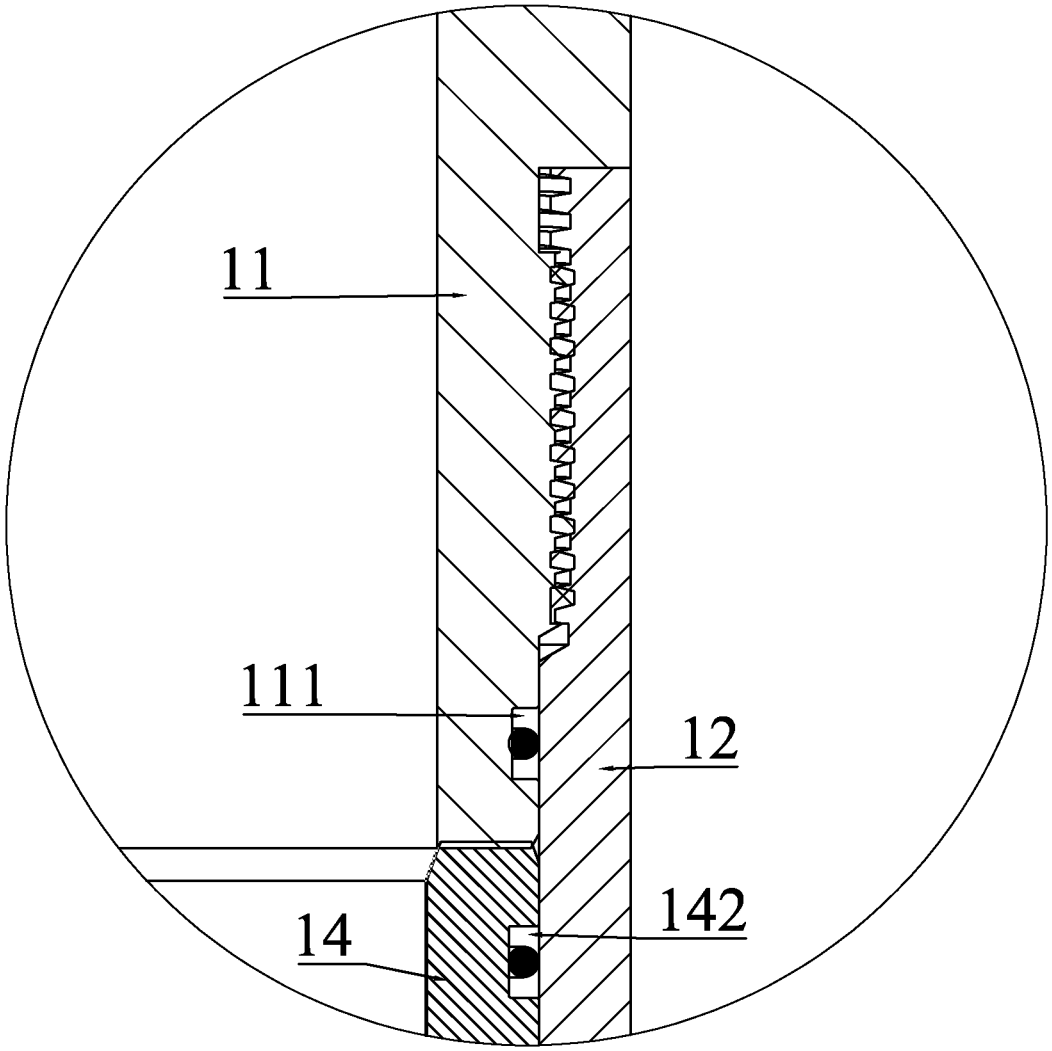
FIG. 11 is a partial enlarged view of A in FIG. 10.
Figure 15:
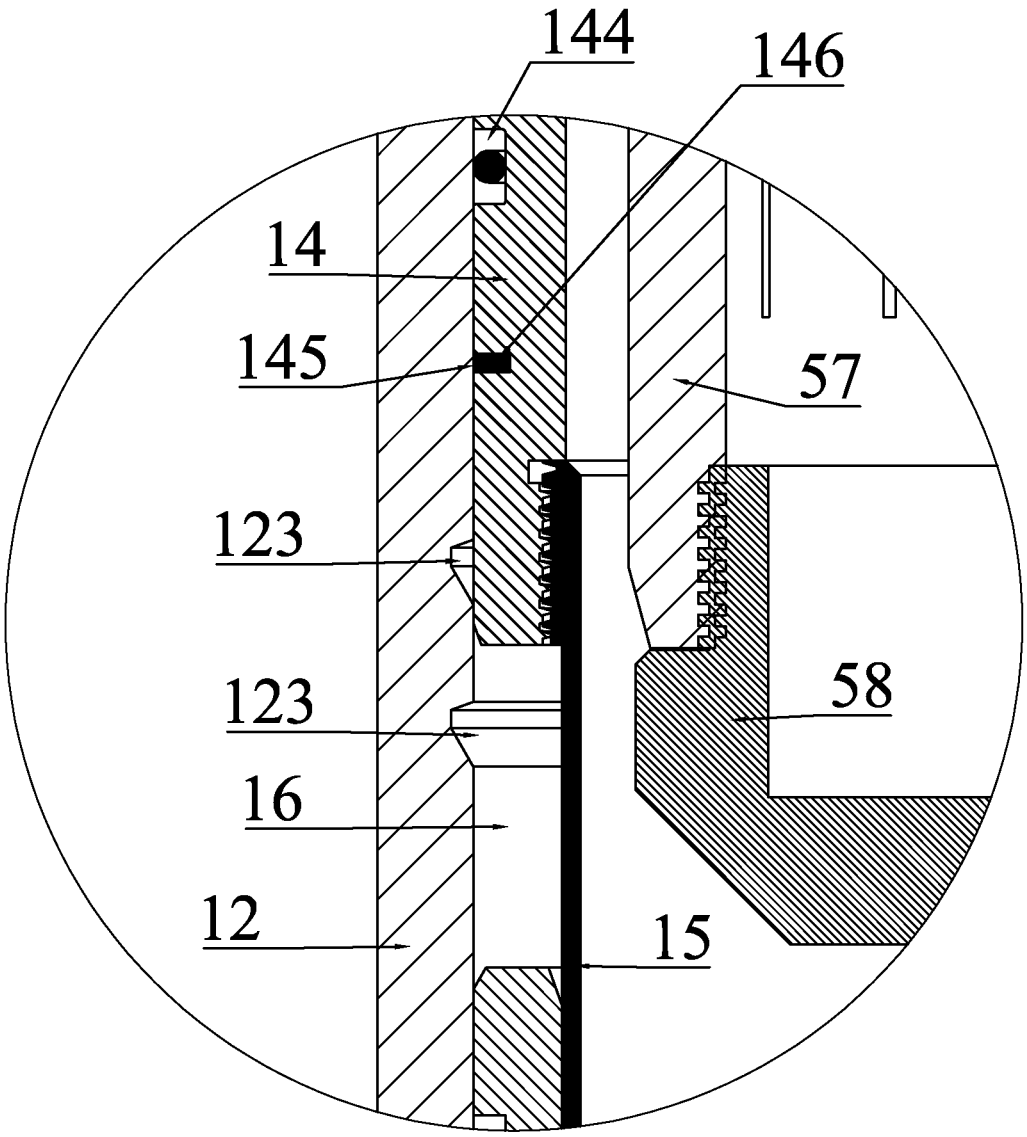
FIG. 15 is a partial enlarged view of E in FIG. 10.
Figure 16:
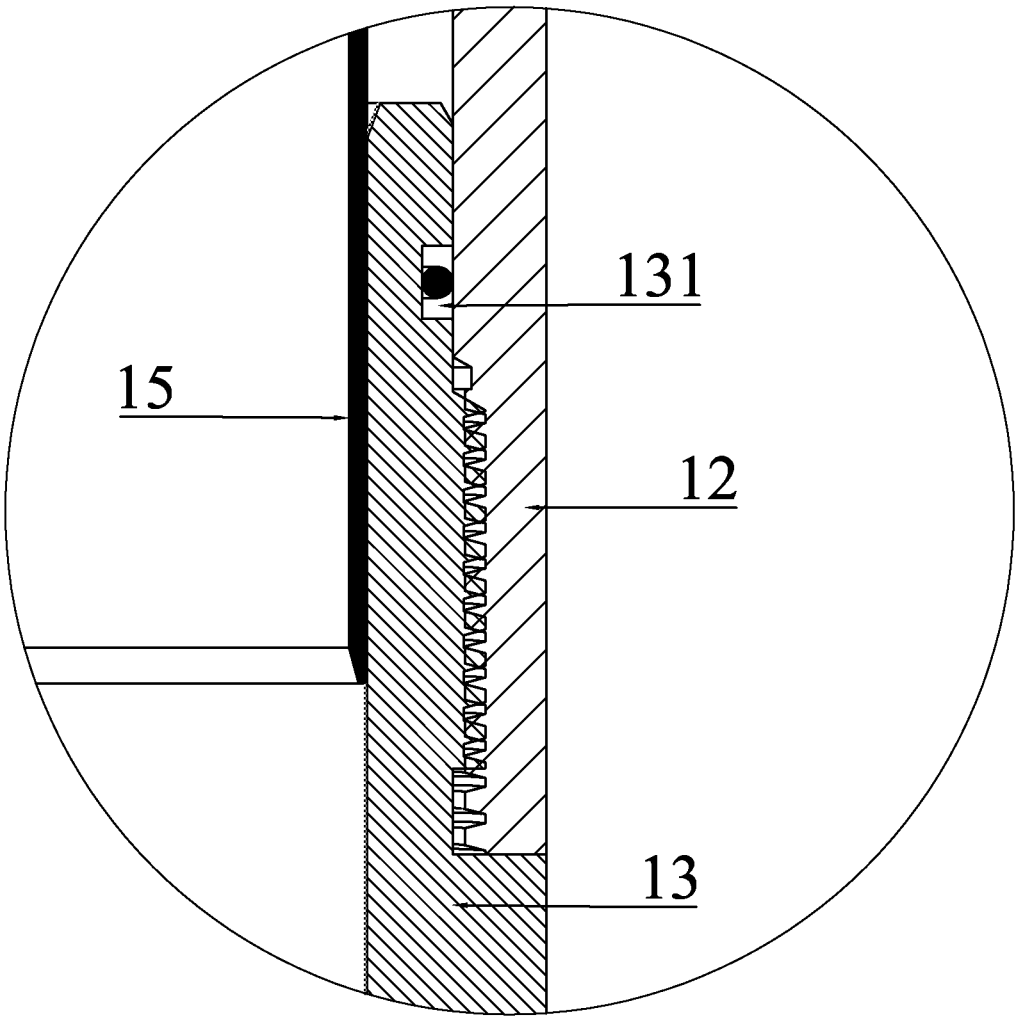
FIG. 16 is a partial enlarged view of F in FIG. 10.

The specific connection method of the outer tube 110 and the inner tube 120 is as follows:

As shown in FIGS. 4, 5, and 11, a top end of the first casing 11 is provided with an internal thread, a bottom end of the first casing 11 is provided with an external thread and a smooth section, the external thread of the first casing 11 is connected to the second casing 12, the smooth section of the first casing 11 tightly fits against the inner wall of the second casing 12, and an end face of a top end of the fourth casing 14 abuts against an end face of the smooth section. As shown in FIGS. 7, 9, and 15, an inner wall of a bottom end of the fourth casing 14 is in threaded connection with the fifth casing 15. As shown in FIGS. 5, 6, and 16, a top end of the third casing 13 is provided with an external thread and a smooth section, a bottom end of the third casing 13 is provided with an internal thread, the external thread of the third casing 13 is connected to the second casing 12, and the smooth section of the third casing 13 tightly fits against the inner wall of the second casing 12.

As shown in FIGS. 7 and 11-16, a first annular groove 111 is formed in an outer wall of the smooth section of the first casing 11, a second annular groove 142, a third annular groove 143 and a fourth annular groove 144 are sequentially formed in the outer wall of the fourth casing 14 from top to bottom, a sixth annular groove 131 is formed in an outer wall of the smooth section of the third casing 13, the third shearing pin 121 is installed in the third annular groove 143, and each of the first annular groove 111, the second annular groove 142, the fourth annular groove 144 and the sixth annular groove 131 is provided with a seal ring except for the third annular groove 143.

As shown in FIG. 15, the inner wall of the second casing 12 is provided with two annular shear grooves 123, the shear grooves 123 are positioned at the gap 16, the outer wall of the fourth casing 14 is provided with a fifth annular groove 145, and two shear C-rings 146 are arranged in the fifth annular groove 145. When the inner tube is not limited by the third shearing pin 121 and moves downwards, the shear grooves 123 are used to accommodate the corresponding shear C-rings 146. It is to be noted here that when the inner tube and the soluble plunger 5 move downward together, the gap 16 is used to avoid the fourth casing 14.

The shear C-ring 146 has two functions: (1) when the inner tube moves downward, the shear C-ring 146 moves with the inner tube into the shear groove 123 of the body; (2) the shear C-ring 146 has a shear value, and when the sliding sleeve needs to be closed again, a shear value higher than the shear C-ring 146 is applied to the inner tube.

The use method is as follows:

The outer tube 110 and the inner tube are assembled together to form a sliding sleeve, and a plurality of sliding sleeves 1 are assembled in sequence according to a specific order.

The plurality of sliding sleeves 1 are lowered into the oil and gas layer in the well, and lengths of clamping grooves 141 of the sliding sleeves are different and gradually increase from top to bottom.

After cementing, the soluble plungers 5 are lowered in a specific order, and the soluble plungers 5 are clamped in the corresponding sliding sleeves.

The pressure is applied to the soluble plunger 5, the elastic sheet 571 is tightly clamped in the clamping groove 141, the soluble ball 51, the ball seat 55, the body tube 56, the rubber cylinder 52, the two pressing ring assemblies 3 and the wedge-shaped body 53 integrally move downwards, the second shearing pin 22 of the elastic tube 57 is sheared off by force, and the first shearing pin 21 of the wedge-shaped body 53 is sheared off by force. In this process, a tip at a bottom of the wedge-shaped body 53 squeezes the slip 54 to enable the slip 54 to open and clamp the inner wall of the sliding sleeve, and the two pressing ring assemblies 3 squeeze the rubber cylinder 52 to enable the rubber of the rubber cylinder 52 to expand and fit tightly against the inner wall of the sliding sleeve to achieve sealing. The third shearing pin 121 is sheared off by force, and the inner tube is not limited by the third shearing pin 121. The inner tube and the soluble plunger 5 move downward together. After the inner tube and the soluble plunger 5 reach a specific position, the shear C ring 146 pops open and is positioned in the corresponding shear groove 123. In this process, the fracturing hole 122 is gradually opened.

Multi-stage segmented fracturing is performed.

The soluble plunger 5 is made of soluble metal material, such as magnesium-aluminum alloy. After fracturing is completed, the soluble plunger 5 is dissolved to achieve full bore.

Figure 8:
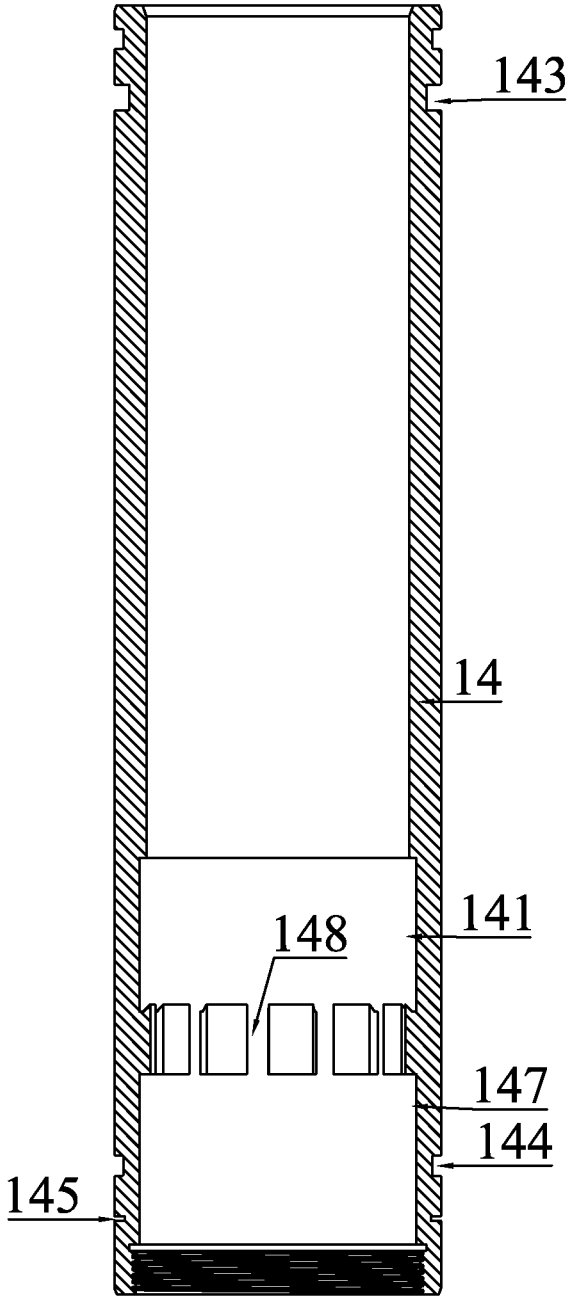
FIG. 8 is a diagram of an interior of a fourth casing.

More specifically, since cement is placed during the cementing stage, to prevent the cement from being retained and solidified in the sliding sleeve, which results in the inability to open the sliding sleeve, this embodiment adopts the following solutions. As shown in FIG. 8, The inner wall of the fourth casing 14 is provided with a plurality of guide grooves 148 in a circumferential array, and an upper end and a lower end of each of the guide grooves 148 are respectively connected to the clamping groove 141 and the avoiding groove 147. After the cement is injected, the cement slurry may be washed clean by the guide grooves 148 by mud or plugging liquid, so that the cement is not easily retained in the sliding sleeve.

In summary, this embodiment achieves precise control of multi-layer fracturing of oil and gas wells by adjusting the length of the elastic sheet 721 to clamp the soluble plunger 5 in the sliding sleeve at a specific position. When a size of the soluble plunger 5 meets the passing condition, the soluble plunger 5 passes through the sliding sleeve smoothly. When the size of the soluble plunger 5 meets the setting condition, the soluble plunger 5 is set at the sliding sleeve. When the soluble plunger 5 is set into the sliding sleeve, the pump rate is increased, and the soluble plunger 5 is set by using high pump rate. The starting shear force of the soluble plunger 5 set is adjustable (1-3 tons), thereby achieving the stratified fracturing of the oil and gas well. This design not only improves the flexibility and accuracy of the fracturing operation, but also reduces the cost and complexity of the operation.

The foregoing embodiments are only used to illustrate the technical ideas and features of the present invention, and are not intended to be exclusive or limiting of the present invention. It should be understood by those skilled in the art that various changes or equivalent substitutions made to the present invention without departing from the scope of the present invention all fall within the scope of protection of the present invention.

What is claimed is:

1. A full-bore cementing and fracturing sliding sleeve system, comprising:

a plurality of soluble plungers and a plurality of sliding sleeves;

wherein a soluble plunger of the plurality of soluble plungers comprises a soluble ball, a rubber cylinder, two pressure ring assemblies comprising a first pressure ring assembly and a second pressure ring assembly, a wedge-shaped body, a slip, a ball seat, a body tube, an elastic tube and a front seat;

wherein an opening is arranged at a top of the ball seat, an inner wall of the ball seat is provided with a step for clamping the soluble ball, wherein an outer wall of a bottom end of the ball seat is in threaded connection with the body tube, wherein starting from the ball seat, the first pressure ring assembly, the rubber cylinder, the second pressure ring assembly, the wedge-shaped body, the slip and the elastic tube are sequentially sleeved outside the body tube, wherein the wedge-shaped body is fixed on the body tube by a plurality of first shearing pins in a circumferential array, wherein an outer wall of the wedge-shaped body adapts to an inner wall of the slip by an inclined plane, wherein the elastic tube is fixed on the body tube by a plurality of second shearing pins in a circumferential array, wherein the front seat is in threaded connection with a bottom of the elastic tube, wherein a plurality of elastic sheets are arranged on an outer wall of the elastic tube in a circumferential array, wherein a bottom end of the elastic sheet is in an acute angle structure in a longitudinal axis direction, a top end of the elastic sheet is in an obtuse angle structure in the longitudinal axis direction, and wherein a strip-shaped groove penetrating through the elastic tube is arranged on each of two sides of the elastic sheet; and wherein a clamping groove is arranged on an inner wall of a sliding sleeve of the sliding sleeves, wherein a bottom end of the clamping groove is in an acute angle structure in the longitudinal axis direction, wherein the clamping groove is used to clamp the elastic sheet corresponding to the soluble plunger, and wherein the plurality of sliding sleeves are assembled together in an order of gradually increasing lengths of the clamping grooves.

2. The full-bore cementing and fracturing sliding sleeve system according to claim 1, wherein the sliding sleeve comprises an outer tube and an inner tube arranged therein, wherein the outer tube comprises a first casing, a second casing and a third casing threadedly connected in sequence, wherein the inner tube comprises a fourth casing and a fifth casing threadedly connected in sequence, wherein an outer wall of the fourth casing fits against an inner wall of the second casing, wherein a gap is provided between an outer wall of the fifth casing and an inner wall of the second casing, wherein an outer wall of the fifth casing fits against an inner wall of the third casing, wherein the second casing is fixedly connected to the fourth casing by a plurality of third shearing pins in a circumferential array, wherein the second casing is further circumferentially arrayed with a plurality of fracturing holes, wherein the third shearing pins are positioned between the first casing and the fracturing holes, and wherein the clamping groove is arranged on an inner wall of the fourth casing.

3. The full-bore cementing and fracturing sliding sleeve system according to claim 2, wherein a top end of the first casing is provided with an internal thread, wherein a bottom end is provided with an external thread and a smooth section, wherein the external thread of the first casing is connected to the second casing, wherein the smooth section of the first casing fits against the inner wall of the second casing, wherein an end face of a top end of the fourth casing abuts against an end face of the smooth section, wherein an inner wall of a bottom end of the fourth casing is in threaded connection with the fifth casing, wherein a top end of the third casing is provided with an external thread and a smooth section, wherein a bottom end is provided with an internal thread, wherein the external thread of the third casing is connected to the second casing, and wherein the smooth section of the third casing fits against the inner wall of the second casing.

4. The full-bore cementing and fracturing sliding sleeve system according to claim 3, wherein a first annular groove is formed in an outer wall of the smooth section of the first casing, wherein a second annular groove, a third annular groove, and a fourth annular groove are sequentially formed in the outer wall of the fourth casing from top to bottom, wherein a sixth annular groove is formed in an outer wall of the smooth section of the third casing, wherein the third shearing pin is installed in the third annular groove, and wherein each of the remaining annular grooves is provided with a seal ring except for the third annular groove.

5. The full-bore cementing and fracturing sliding sleeve system according to claim 2, wherein the inner wall of the second casing is provided with two annular shear grooves, wherein the outer wall of the fourth casing is provided with a fifth annular groove, wherein two shear C-rings are arranged in the fifth annular groove, and wherein when the third shearing pin is sheared off by force and the inner tube moves downwards, the shear grooves are used to accommodate corresponding shear C-rings.

6. The full-bore cementing and fracturing sliding sleeve system according to claim 1, wherein a plurality of centralizing fins are further arrayed on an outer wall of the elastic tube along a circumferential direction, wherein the number and positions of the centralizing fins correspond to those of the elastic sheets one by one, wherein the centralizing fin is positioned between the elastic sheet and the front seat, wherein a bottom end and a top end of the centralizing fin are in an obtuse angle structure, wherein a bottom end of the strip-shaped groove is positioned between the centralizing fin and the front seat, wherein a circle of avoiding grooves are formed in an inner wall of a fourth casing, wherein when the soluble plunger is clamped in a corresponding clamping groove, wherein the centralizing fin is positioned in the avoiding groove, and wherein an outer diameter of the centralizing fin is greater than an outer diameter of the elastic sheet.

7. The full-bore cementing and fracturing sliding sleeve system according to claim 6, wherein a plurality of guide grooves are circumferentially arrayed on the inner wall of the fourth casing, and wherein two ends of each of the guide grooves are communicated with the clamping groove and the avoiding groove.

8. The full-bore cementing and fracturing sliding sleeve system according to claim 1, wherein a groove is formed in an area among the ball seat, wherein the wedge-shaped body and an outer wall of the body tube, wherein the two pressure ring assemblies are symmetrically arranged in the groove up and down, wherein each of the pressure ring assemblies sequentially comprises a first ring, a second ring, a third ring and a fourth ring, wherein for an upper pressure ring assembly, the first ring adapts to the ball seat by an inclined plane, the first ring adapts to the second ring by a step, the second ring adapts to the third ring by an inclined plane, and the fourth ring adapts to the rubber cylinder by a step.

9. The full-bore cementing and fracturing sliding sleeve system according to claim 1, wherein a circle of trapezoidal grooves is provided on an inner wall of the rubber cylinder, wherein a sealing sleeve and a sealing ring are arranged in the trapezoidal groove, and wherein the sealing ring is positioned inside the sealing sleeve.

10. The full-bore cementing and fracturing sliding sleeve system according to claim 1, wherein two circles of inserted pins are arranged on an outer wall of the slip, and wherein notches are arranged at corresponding positions at two ends of the slip.

* * * * *